US005438555A

United States Patent [19]

Kim

[11] Patent Number: 5,438,555

[45] Date of Patent: Aug. 1, 1995

[54] MULTI-PURPOSE KEY RING

[76] Inventor: Ho C. Kim, 105 Windham Loop, Staten Island, N.Y. 10314

[21] Appl. No.: 270,915

[22] Filed: Jul. 5, 1994

[51] Int. Cl.[6] ..... G04B 47/00

[52] U.S. Cl. ..... 368/10; 368/107; 368/243

[58] Field of Search ..... 368/10, 243, 107–113, 368/243–250

[56] References Cited

U.S. PATENT DOCUMENTS

| | | | |
|---|---|---|---|
| D. 307,979 | 5/1990 | Purvis | D3/62 |
| 4,642,827 | 2/1987 | Karuzas | 7/151 |
| 4,769,799 | 9/1988 | Matsukage | 368/278 |
| 4,805,820 | 2/1989 | Kearney et al. | 224/252 |
| 5,033,141 | 7/1991 | Kang | 7/151 |
| 5,077,850 | 1/1992 | Brubaker | 7/151 |
| 5,318,177 | 6/1994 | Isacson | 368/10 |

*Primary Examiner*—Bernard Roskoski
*Attorney, Agent, or Firm*—Brumbaugh, Graves, Donohue & Raymond

[57] ABSTRACT

A multi-purpose key ring comprises a pouch having a closable opening and adapted to receive coins, a ring adapted to hold keys and attached to the pouch, and a timer attached to the pouch, settable to a selected one of a plurality of time periods, and having a sounder for signaling the end of the selected time period a predetermined time before the end of the selected time period. The ring can be configured as a bottle opener and a prying tool for a liftable tab of a beverage can.

12 Claims, 2 Drawing Sheets

MULTI-PURPOSE KEY RING

BACKGROUND OF THE INVENTION

People who drive cars in urban areas need to carry change for parking meters and must be careful not to allow the parking meter time to run out, lest they incur a costly ticket for illegal parking. They also find it useful to have a key ring for their car key and perhaps other keys as well. Most people meet these three needs by separate means. They carry change in a pocket or change purse, have a watch to keep track of the time on parking meters, and have a key chain or ring for their keys.

SUMMARY OF THE INVENTION

The present invention provides a single device for carrying change, keeping track of a selected time period, such as the time on a parking meter, and carrying keys. In particular, there is provided, in accordance with the present invention, a multi-purpose key ring comprising a pouch having a closable opening and adapted to receive coins, a ring adapted to hold keys and attached to the pouch, and a timer attached to the pouch, settable to a selected one of a plurality of time periods and having a sounder for signaling the end of the selected time period a predetermined time before the end of the selected time period.

In its broadest aspect, the invention is very useful, in particular, to drivers in urban areas where parking meters are in widespread use. The pouch provides a place to keep coins of the denominations used in the meters. The timer allows the user to pay for a certain amount of time on the meter, or use remaining time already on the meter, and set the timer for the available time in the parking spot. Rather than signaling when the set time has expired, which may be too late for the user to go to the parking spot and either leave the spot or put in another coin, the timer signals by an audible signal at a predetermined time prior to the end of the time period set on the timer. The advance signal gives the user a period of time to go to the parking spot before the time has run out, thus avoiding the possibility of being ticketed within a short time after the time on the meter has expired. Lastly, the key ring provides the user with a place for the car key and any other keys as well. By associating the coin pouch, the timer and the car key, the user is sure to have the coin pouch and timer with him or her when using the car.

In a preferred embodiment, the pouch is formed of a durable flexible sheet material, such as natural or artificial leather. Preferably, a blank of the sheet material of generally hourglass shape is folded over on itself along a fold line at a neck portion of the blank and joined along portions of the margins of the blank on opposite sides of the neck but leaving the opening. Although various forms of closure for the pouch can be used, a desirable type is one composed of leaf springs received in pockets formed in opposite sides of the pouch adjacent the opening. Such a closure is opened by simply pressing opposite ends of the closure toward each other, which causes the springs to bulge outwardly. When the ends are released, the springs straighten resiliently and close the opening.

The timer can be a solid state digital timer having an LCD for displaying the selected time when the timer is started and the time remaining when the timer is running, a selector key for each time period, a start key, and a reset key. Such a timer is inexpensive and easy to use. It is desirable that the timer be fastened to a wall of the pouch by a ring portion of the timer, leaving a body portion of the timer unattached. Leaving the body of the timer free of attachment to the pouch simplifies the construction and allows the pouch walls to bulge when the pouch holds several coins; the timer body does not restrict the bulging of the pouch, which may, therefore, contain more coins that it could if the timer body were to be attached to the side walls.

An optional but very useful feature of the invention is the formation of the ring that holds the keys (or several keys) as a bottle opener. In particular, the ring of the invention includes a lug portion adapted to engage a lip portion of a bottle cap and a tongue portion adapted to engage a top portion of the bottle cap. The driver or his passengers may want to open a bottle of soda while in the car, and the invention includes a device for doing so. As a further optional but preferred aspect, an edge portion of the ring remote from the pouch is tapered to a thin edge so as to be insertable under a liftable tab portion of a can closure to facilitate lifting the tab portion. The ring should include a handle portion to assist in prying off bottle caps, the handle portion being received within the pocket.

For a better understanding of the invention, reference may be made to the following description of an exemplary embodiment, taken in conjunction with the accompanying drawings.

DESCRIPTION OF THE EMBODIMENT

Figure 1:
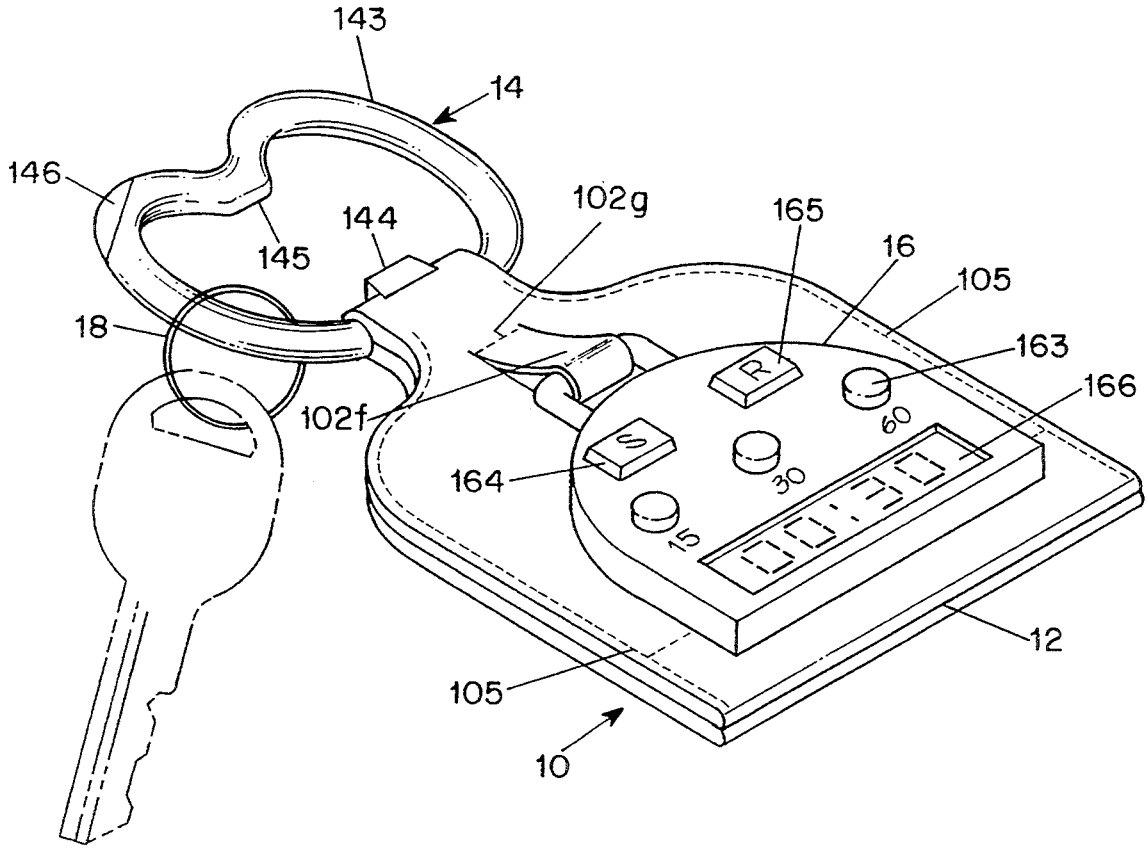
FIG. 1 is a pictorial view of the embodiment.

The embodiment shown in the drawings includes a pouch 10 having a closable opening 12 and adapted to receive coins C, a ring 14 adapted to hold keys and attached to the pouch, and a timer 16 attached to the pouch. The timer is settable to a selected one of a plurality of time periods and has a sounder for audibly signaling the end of the selected time period a predetermined time before the end of the selected time period.

Figure 2:
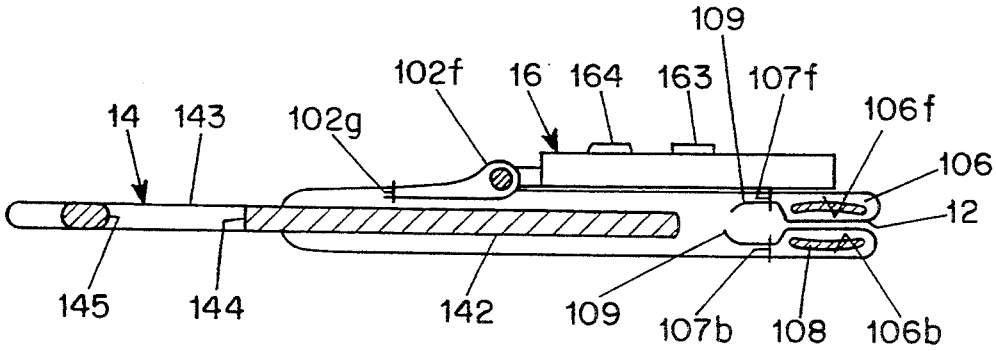
FIG. 2 is a side cross-sectional view of the embodiment.
Figure 3:
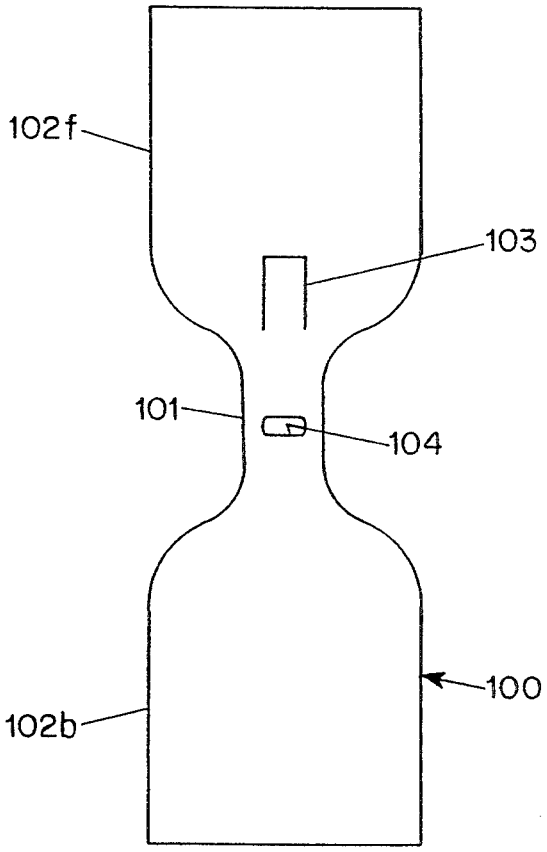
FIG. 3 is a plan view of a blank from which the pouch is formed.

Referring to FIGS. 2 and 3, the pouch 10 is formed from a blank 100 of a durable, flexible sheet material, such as natural or synthetic leather. The blank is of generally hourglass shape and includes a neck portion 101 and a pair of body portions 102*f* and 102*b*. A tab 103 is formed by a three-sided slit in what will become the front wall of the pouch, i.e., the body portion 102*f*. A hole 104 is cut out of the neck portion 101. The blank 100 is formed into the pouch 10 by folding it back on itself along a bisecting fold line at the neck, as is apparent from FIG. 1, and suitably fastening portions of the margins, such as by stitching 105. Before folding and stitching the pouch, other operations are carried out, as described below.

One such operation is to form pockets 106*f* and 106*b* along the extreme opposite ends by folding over a band of each body portion and stitching it along stitch lines 107*f* and 107*b*. A leaf spring 108 is inserted into each pocket at a suitable time before stitching the pouch along the stitch lines 105. The leaf springs extend nearly the entire lengths of the pockets 106. Each leaf spring is cupped transversely along its length. The cup shape causes each spring to bend outwardly away from the other spring when the ends are squeezed toward each other lengthwise of the springs, which opens up the opening 12. When the ends are released, the springs resile, thereby reclosing the opening 12. The stitch lines **106*b* and 106*f* are formed slightly away from the extreme edge of the blank, thus leaving little strips 109 of material within the pouch. The strips help keep coins from falling out through the slit formed by the closed opening 12** by presenting retaining shoulders.

Another operation performed on the blank before forming the pouch is to attach the timer 16 to the front panel **106*f* of the pouch 10. The timer 16 has a lug 161 projecting from the upper edge of its case. A slot 162 in the lug receives a loop formed by inserting the tab 103 of the panel 102*f* through the slot from outside in, folding it under the inside of the panel 102*f*, and securing its free end, such as by stitching 102*g*** or stapling (not shown).

Figure 4:
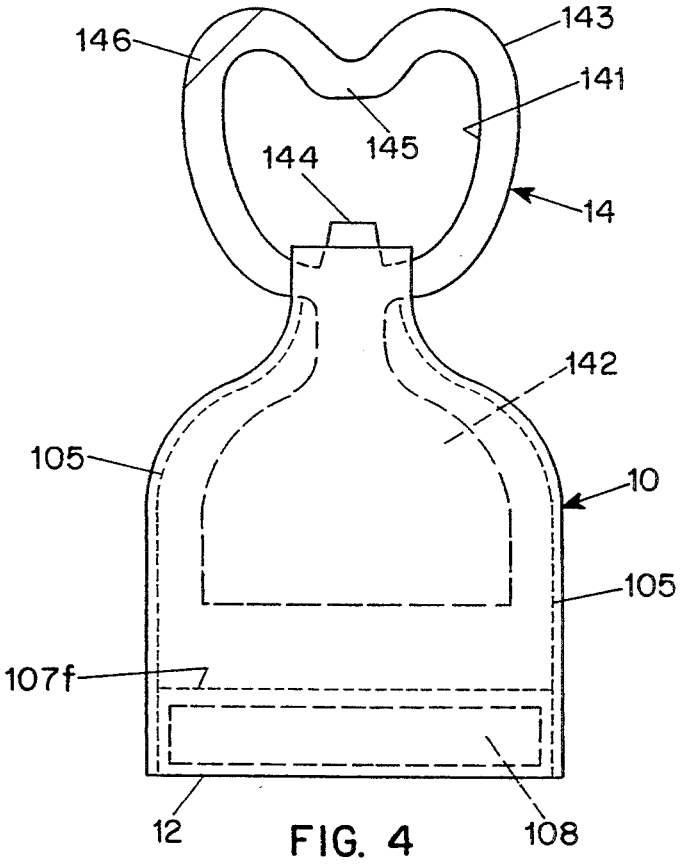
FIG. 4 is a plan view of the pouch and ring of the embodiment, the timer not being shown.

Prior to installing the springs 108, the bottom panel **102*b* of the pouch 10 is passed through the hole 141 in the ring 14 so that when the panels 102*b* and 102*f* are folded to form the pouch 10, they straddle a handle portion 142 of the ring, which is received within the pouch 10 (FIGS. 2 and 4). The ring 14 has a ring portion 143 that is generally heart shaped and includes a lug portion 144 that is adapted to engage a lip portion of a bottle cap and a tongue portion 145 that is adapted to engage a top portion of the bottle cap. By grasping the handle portion 142 (or more accurately the part of the pouch overlying the handle portion), a user can easily pry off a bottle cap with the ring 14. The timer 16 can be pivoted up to allow the handle portion 142 to be grasped. The lug portion 144 protrudes from the pouch through the hole 104 (FIG. 3**).

An edge portion 146 of the ring remote from the pouch is tapered to a thin edge so as to be insertable under a liftable tab portion of a can closure of the type that is bent into the can when the tab is lifted to facilitate lifting the tab portion. The use of the edge portion 146 avoids breaking a finger nail when opening the beverage cans with liftable tabs that are currently almost universal.

After the springs 108 are inserted into the respective pockets **106*b*, 106*f*, the pouch can be completed by forming the stitches 105. It will be seen (FIG. 4) that the stitches 105 close the ends of the spring pockets. Note also that the sides of the handle portion 142 of the ring 14 are set in from the sides of the pockets—this allows the ends of the pouch opening 12** to be squeezed toward each other to open the opening to receive and dispense coins.

The timer 16 is produced using well-known technology that is in widespread use in digital watches with timer functions. For convenience of operation, the timer is custom-made to provide selected time periods, 15, 30 and 60 minutes being preferred, inasmuch as those are times commonly found on parking meters. When a parking meter has a time longer than 60 minutes, it is usually a multiple of an hour, such as two hours. In such a case the user can select 60 minutes, let the time run out once and reset the timer for another 60 minutes. The timer has selector keys 163 for each time period, a start key 164 for starting the time running, and a reset key 165 for stopping and resetting the timer to a ready state, should that be necessary (e.g., to correct a wrong selection). When the user selects the desired time with a key 163, the selected time is displayed on an LCD 166. After the timer is started, the LCD displays the remaining time.

Because the user will want to reach his or her car before the time on the meter runs out, the timer provides an audible signal on a sounder at a predetermined time before the time on the timer runs out. The time is built into the timer and cannot be changed by the user. An advance signal five minutes before the time runs out is suitable.

As shown in FIG. 1, one or more keys K are joined to the key ring 14 by a separate ring 18, which may be the common spiral spring ring widely used for key rings or a ball chain. When the ring 14 is configured as a bottle opener, it is inconsistent with maintaining a low cost and high strength to construct so that it can be opened. The invention need not include the bottle opener feature, in which case a ring that can be opened to accept keys may be used in place of the ring 14.

I claim:

1. A multi-purpose key ring comprising a pouch formed a durable flexible sheet material, having a closable opening and adapted to receive coins, a ring adapted to hold keys and attached to the pouch, and a timer attached to the pouch, settable to a selected one of a plurality of time periods and having a sounder for signaling the end of the selected time period a predetermined time before the end of the selected time period, the timer being a solid state digital timer having an LCD for displaying the selected time when the timer is started and the time remaining when the timer is running, a selector key for each time period, a start key, and a reset key.

2. A multi-purpose key ring according to claim 1 wherein the pouch is formed of a durable flexible sheet material.

3. A multi-purpose key ring according to claim 2 wherein the sheet material is a natural or artificial leather.

4. A multi-purpose key ring according to claim 2 wherein the pouch is formed from a blank of the sheet material of generally hourglass shape that is folded over on itself along a fold line at a neck portion of the blank and joined along portions of the margins of the blank on opposite sides of the neck but leaving the opening.

5. A multi-purpose key ring according to claim 2 wherein the opening is closed by leaf springs received in pockets formed in opposite sides of the pouch adjacent the opening.

6. A multi-purpose key ring according to claim 1 wherein the timer is fastened to a wall of the pouch by a ring portion of the timer, leaving a body portion of the timer unattached.

7. A multi-purpose key ring according to claim 1 wherein the ring is a bottle opener and includes a lug portion adapted to engage a lip portion of a bottle cap and a tongue portion adapted to engage a top portion of the bottle cap.

8. A multi-purpose key ring according to claim 7 wherein an edge portion of the ring remote from the pouch is tapered to a thin edge so as to be insertable under a liftable tab portion of a can closure to facilitate lifting the tab portion.

9. A multi-purpose key ring according to claim 7 wherein the ring includes a handle portion, the handle portion being received within the pocket.

10. A multi-purpose key ring comprising a pouch formed from a blank of a durable flexible sheet material of generally hourglass shape that is folded over on itself along a fold line at a neck portion of the blank and joined along portions of the margins of the blank on opposite sides of the neck but leaving a closable opening and adapted to receive coins, a ring adapted to hold keys and attached to the pouch, and a timer attached to the pouch, settable to a selected one of a plurality of time periods and having a sounder for signaling the end of the selected time period a predetermined time before the end of the selected time period, the timer being a solid state digital timer having an LCD for displaying the selected time when the timer is started and the time remaining when the timer is running, a selector key for each time period, a start key, and a reset key.

11. A multi-purpose key ring according to claim 10 wherein the opening is closed by leaf springs received in pockets formed in opposite sides of the pouch adjacent the opening.

12. A multi-purpose key ring according to claim 10 wherein the timer is fastened to a wall of the pouch by a ring portion of the timer, leaving a body portion of the timer unattached.

* * * * *